US011639259B1

(12) United States Patent
Snodgrass

(10) Patent No.: US 11,639,259 B1
(45) Date of Patent: May 2, 2023

(54) COMBINATION LOCK FOR LIQUID BOTTLES

(71) Applicant: Jason Snodgrass, Wesley Chapel, FL (US)

(72) Inventor: Jason Snodgrass, Wesley Chapel, FL (US)

( * ) Notice: Subject to any disclaimer, the term of this patent is extended or adjusted under 35 U.S.C. 154(b) by 44 days.

(21) Appl. No.: 17/341,435

(22) Filed: Jun. 8, 2021

(51) Int. Cl.
*B65D 55/14* (2006.01)
*B65D 50/06* (2006.01)
*B65D 41/04* (2006.01)

(52) U.S. Cl.
CPC ..... *B65D 55/145* (2013.01); *B65D 41/0407* (2013.01); *B65D 50/062* (2013.01); *B65D 2215/04* (2013.01); *B65D 2255/00* (2013.01)

(58) Field of Classification Search
CPC ..... G06Q 10/10; G09F 11/02; B65D 51/245; B65D 50/06; B65D 47/265; B65D 55/145; B65D 41/0407; B65D 50/062; B65D 2215/04; B65D 2255/00; A61J 1/03; Y10T 70/7367; Y10T 70/7401; Y10T 70/7418
See application file for complete search history.

(56) References Cited

U.S. PATENT DOCUMENTS 3,407,954 A * 10/1968 Millis ..... B65D 55/145 215/44
3,445,021 A * 5/1969 Johnson ..... B65D 55/145 215/206
3,684,117 A * 8/1972 Leopoldi ..... B65D 55/145 215/206
3,828,519 A 8/1974 Levey
3,850,324 A * 11/1974 Meyer ..... B65D 55/145 215/221
8,875,915 B2 11/2014 Serell
8,931,652 B2 1/2015 Simpson
8,938,999 B2 1/2015 Dahl
10,099,830 B2 10/2018 Martinez
D891,224 S 7/2020 Xiang
2005/0263411 A1 12/2005 Harrington
2006/0180566 A1* 8/2006 Mataya ..... A61J 1/1425 215/230
2011/0079058 A1 4/2011 Nielsen
2011/0210136 A1 9/2011 Wang

FOREIGN PATENT DOCUMENTS

WO 2011028845 3/2011

* cited by examiner

*Primary Examiner* — Shawn M Braden
(74) *Attorney, Agent, or Firm* — Kyle A. Fletcher, Esq.

(57) ABSTRACT

The combination lock for a liquid bottle is a container. The combination lock for a liquid bottle is configured for use in storing a liquid. The combination lock for a liquid bottle is a secured device. By secured device is meant that the structure of the combination lock for a liquid bottle is formed with a lock that prevents unauthorized entry into the combination lock for a liquid bottle. The combination lock for a liquid bottle comprises a bottle, a bottle cap, and a permutation lock structure. The permutation lock structure mounts in the bottle cap. The bottle cap attaches to the bottle. The bottle cap forms a fluid impermeable seal that encloses the liquid in the bottle. The permutation lock structure fixes the bottle cap in the closed position.

15 Claims, 5 Drawing Sheets

COMBINATION LOCK FOR LIQUID BOTTLES

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

Field of the Invention

The present invention relates to the field of containers including accessories for a container, more specifically, the application of a permutation lock to a container. (B65D55/145)

SUMMARY OF INVENTION

The combination lock for a liquid bottle is a container. The combination lock for a liquid bottle is configured for use in storing a liquid or a solid. The combination lock for a liquid bottle is a secured device. By secured device is meant that the structure of the combination lock for a liquid bottle is formed with a lock that prevents unauthorized entry into the combination lock for a liquid bottle. The combination lock for a liquid bottle comprises a bottle, a bottle cap, and a permutation lock structure. The permutation lock structure mounts in the bottle cap. The bottle cap attaches to the bottle. The bottle cap forms a fluid impermeable seal that encloses the liquid in the bottle. The permutation lock structure fixes the bottle cap in the closed position.

These together with additional objects, features and advantages of the combination lock for a liquid bottle will be readily apparent to those of ordinary skill in the art upon reading the following detailed description of the presently preferred, but nonetheless illustrative, embodiments when taken in conjunction with the accompanying drawings.

In this respect, before explaining the current embodiments of the combination lock for a liquid bottle in detail, it is to be understood that the combination lock for a liquid bottle is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the combination lock for a liquid bottle.

It is therefore important that the claims be regarded as including such equivalent construction insofar as they do not depart from the spirit and scope of the combination lock for a liquid bottle. It is also to be understood that the phraseology and terminology employed herein are for purposes of description and should not be regarded as limiting.

BRIEF DESCRIPTION OF DRAWINGS

The accompanying drawings, which are included to provide a further understanding of the invention are incorporated in and constitute a part of this specification, illustrate an embodiment of the invention and together with the description serve to explain the principles of the invention. They are meant to be exemplary illustrations provided to enable persons skilled in the art to practice the disclosure and are not intended to limit the scope of the appended claims.

DETAILED DESCRIPTION OF THE EMBODIMENT

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

Figure 1:
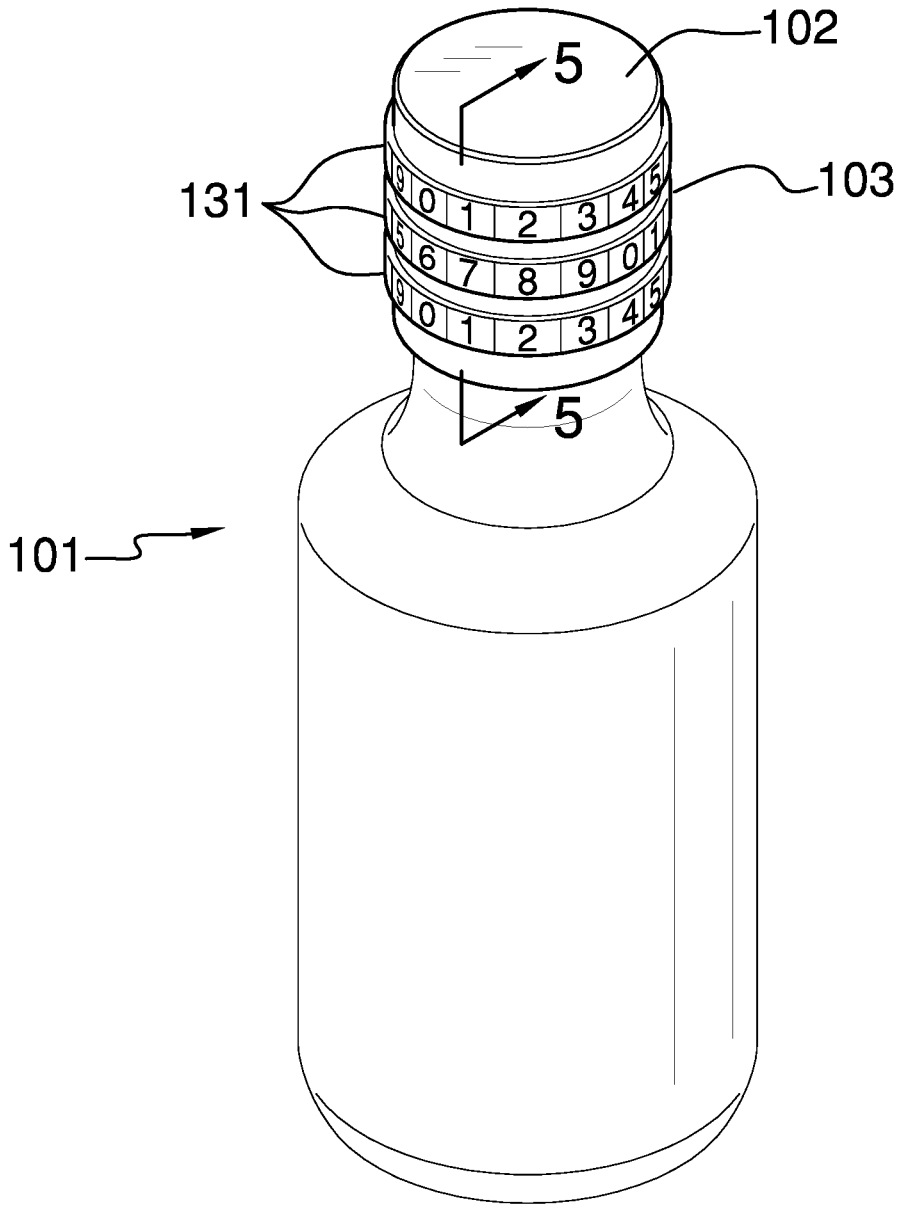
FIG. 1 is a perspective view of an embodiment of the disclosure.
Figure 2:
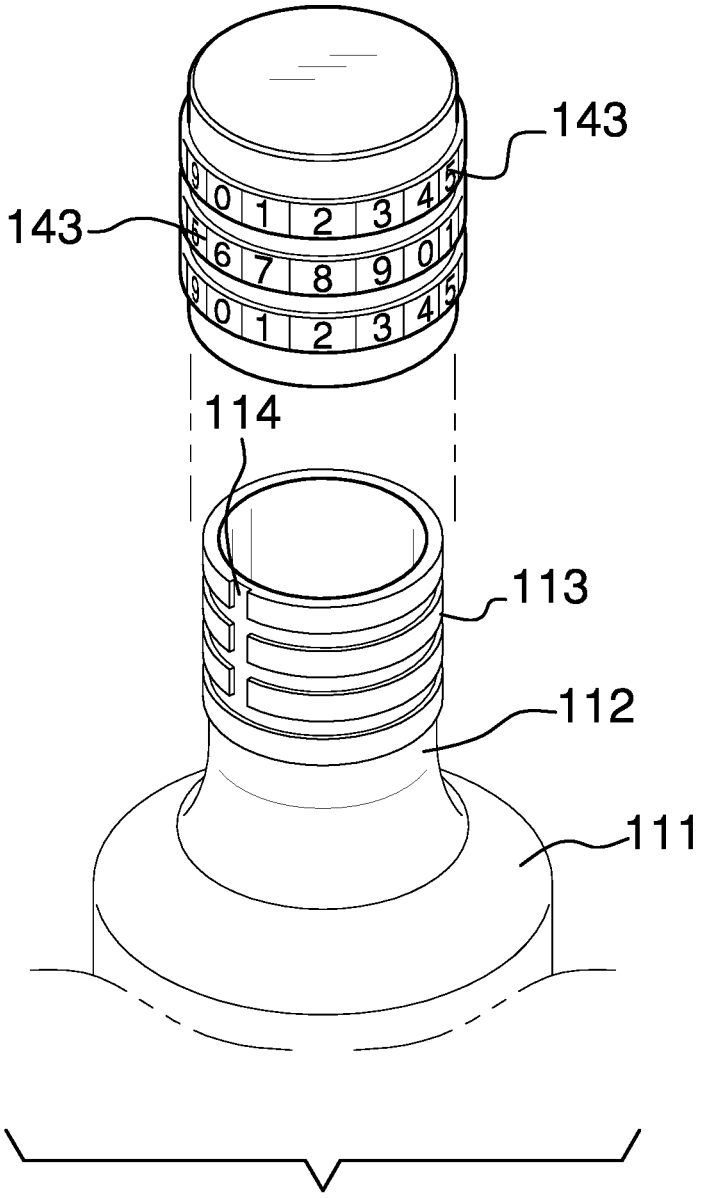
FIG. 2 is an exploded perspective view of an embodiment of the disclosure.
Figure 3:
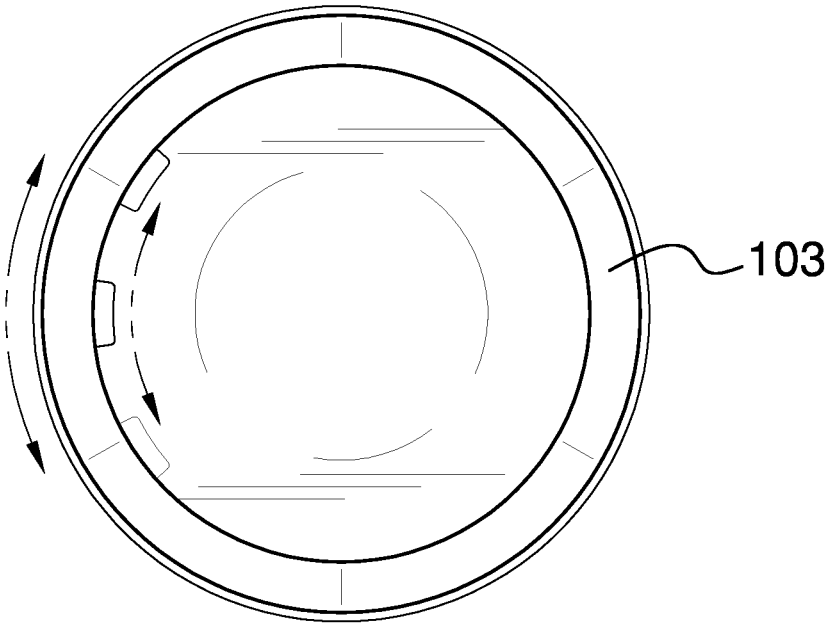
FIG. 3 is a detail view of an embodiment of the disclosure.
Figure 4:
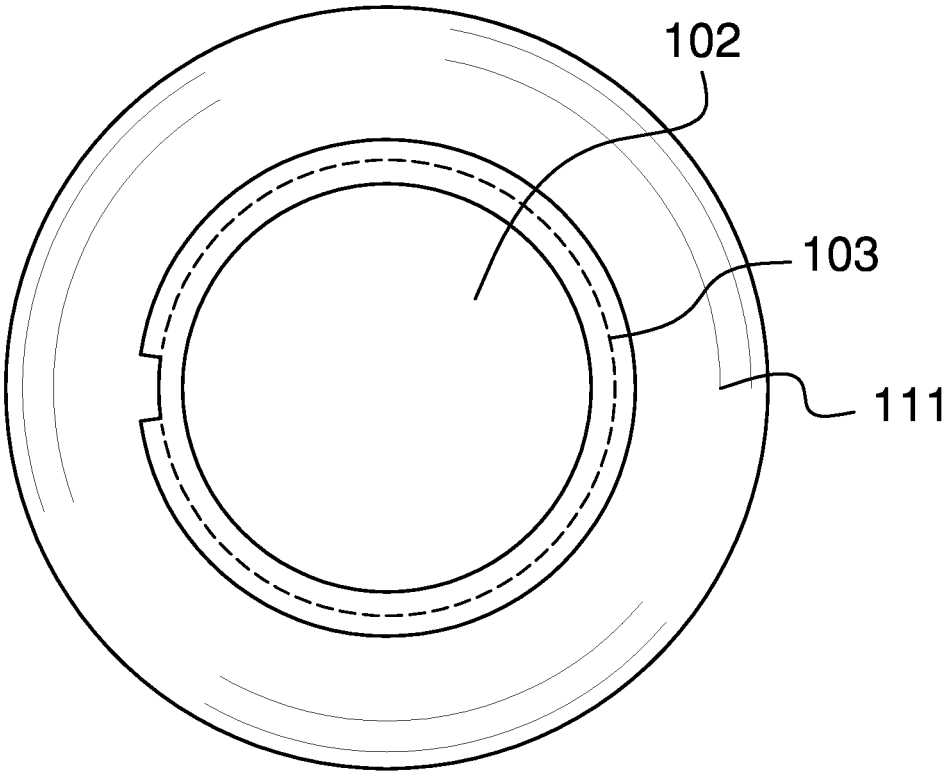
FIG. 4 is a top view of an embodiment of the disclosure.
Figure 5:
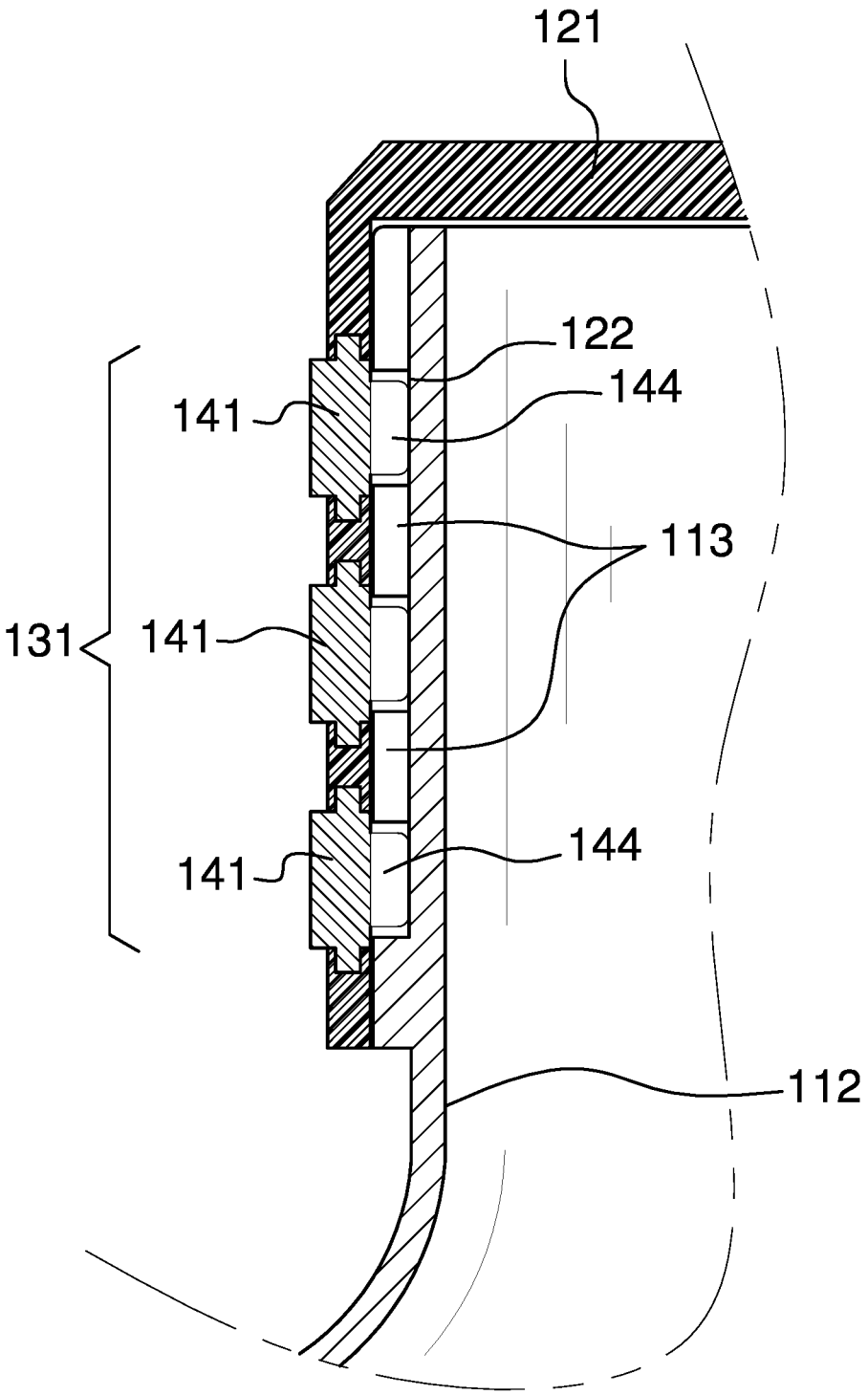
FIG. 5 is a cross-sectional view of an embodiment of the disclosure across 5-5 as shown in FIG. 1.
Figure 6:
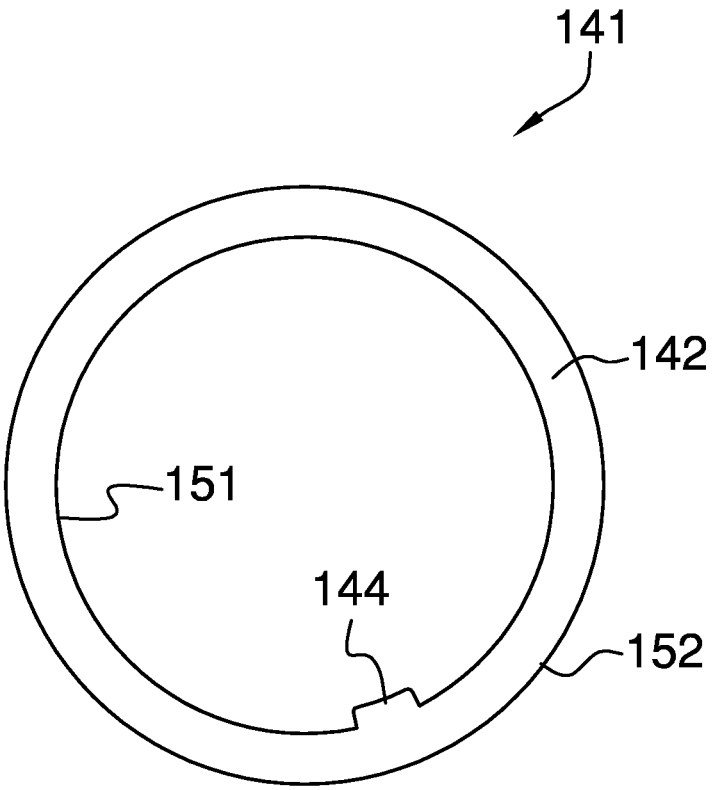
FIG. 6 is a detail view of an embodiment of the disclosure.

Detailed reference will now be made to one or more potential embodiments of the disclosure, which are illustrated in FIGS. 1 through 6.

The combination lock for a liquid bottle 100 (hereinafter invention) is a containment structure. The invention 100 is configured for use in storing a liquid. The invention 100 is a secured device. By secured device is meant that the structure of the invention 100 is formed with a lock that prevents unauthorized entry into the invention 100. The invention 100 comprises a bottle 101, a bottle 101 cap 102, and a permutation lock structure 103. The permutation lock structure 103 mounts in the bottle 101 cap 102. The bottle 101 cap 102 attaches to the bottle 101. The bottle 101 cap 102 forms a fluid impermeable seal that encloses the liquid in the bottle 101. The permutation lock structure 103 fixes the bottle 101 cap 102 in the closed position.

The bottle 101 forms a containment structure. The bottle 101 forms a fluid impermeable structure suitable for use in storing a liquid. The bottle 101 has a composite prism structure. The bottle 101 comprises a container 111, a neck 112, an exterior screw thread 113, and an exterior pin slot 114.

The container 111 is a prism-shaped structure. The container 111 forms a fluid impermeable containment space. The container 111 forms the primary storage space for the liquid. The container 111 approximates a pan shape. By approximates is meant that the open face of the pan shape of the container 111 is enclosed by the neck 112.

The neck 112 forms an aperture that provides access to the interior containment space of the container 111. The neck 112 is a prism-shaped structure. The neck 112 is a tubular structure. The structure of the neck 112 encloses the open face of the pan shape of the container 111 such that the neck 112 and the container 111 combine to form a composite prism structure. The liquid contained in the bottle 101 is introduced into and removed from the container 111 through the neck 112.

The exterior screw thread 113 forms a portion of the threaded connection that secures the bottle 101 cap 102 to the neck 112 of the bottle 101. The exterior screw thread 113 is formed on the exterior lateral face of the prism structure of the neck 112. The exterior screw thread 113 is defined elsewhere in this disclosure.

The exterior pin slot 114 is a negative space. The exterior pin slot 114 is a prism-shaped structure. The exterior pin slot 114 is formed into the exterior screw thread 113 of the bottle 101 such that the center axis of the prism shape of the exterior pin slot 114 is parallel to the center axis of the composite prism structure of the bottle 101. The exterior pin slot 114 forms a release channel used by the permutation lock structure 103 to allow the bottle 101 cap 102 to be placed onto and removed from the bottle 101.

The bottle 101 cap 102 is a pan shaped structure. The bottle 101 cap 102 attaches to the bottle 101 to form a fluid impermeable seal. The bottle 101 cap 102 attaches to the bottle 101 using a threaded connection. The bottle 101 cap 102 encloses the liquid in the bottle 101. The bottle 101 cap 102 screws onto the neck 112 of the bottle 101. The bottle 101 cap 102 comprises a pan structure 121 and an interior screw thread 122.

The pan structure 121 is a prism-shaped structure. The pan structure 121 is a hollow structure. The pan structure 121 has a pan shape. The pan shape of the pan structure 121 is geometrically similar to the neck 112 of the bottle 101. The span of the length of the inner diameter of the pan structure 121 is greater than the span of the length of the outer diameter of the neck 112 of the bottle 101 such that the neck 112 inserts into the pan structure 121 as the bottle 101 cap 102 screws onto the neck 112. The pan structure 121 encloses the neck 112 of the bottle 101. The pan structure 121 forms a fluid impermeable seal with the neck 112.

The interior screw thread 122 forms a portion of the threaded connection that secures the bottle 101 cap 102 to the neck 112 of the bottle 101. The interior screw thread 122 is formed on the interior lateral face of the pan structure 121. The interior screw thread 122 is sized such that the exterior screw thread 113 screws into the interior screw thread 122 as the bottle 101 cap 102 is screwed onto the neck 112 of the bottle 101.

The permutation lock structure 103 attaches to the bottle 101 cap 102. The permutation lock structure 103 releasably locks the bottle 101 cap 102 to the bottle 101 in the closed position. The permutation lock structure 103 prevents the liquid from being removed from the bottle 101 when the bottle 101 cap 102 encloses the bottle 101. The permutation lock structure 103 is a permutation lock. The permutation lock structure 103 is released by entering a previously determined number into the permutation lock structure 103. The permutation lock structure 103 is a prism-shaped structure. The permutation lock structure 103 is geometrically similar to the neck 112 of the bottle 101. The permutation lock structure 103 mounts on the exterior lateral face of the pan structure 121 of the bottle 101 cap 102.

The permutation lock structure 103 further comprises a plurality of permutation rotors 131. The plurality of permutation rotors 131 forms a framework that attaches to the lateral face of the pan structure 121 of the bottle 101 cap 102. The plurality of permutation rotors 131 forms a rotating structure.

The plurality of permutation rotors 131 presents a plurality of images such that the plurality of images are visible from the exterior of the bottle 101 cap 102. The position of any first image presented by the plurality of permutation rotors 131 changes relative to the position of at least one other image presented by the bottle 101 cap 102 when the plurality of permutation rotors 131 is rotated. When the plurality of images presented by the plurality of permutation rotors 131 are aligned into a previously determined pattern, the permutation lock structure 103 goes into an "unlocked" state that allows the bottle 101 cap 102 to be screwed onto and removed from the bottle 101. When the plurality of images presented by the plurality of permutation rotors 131 are not aligned into the previously determined pattern, the permutation lock structure 103 goes into a "locked" state that prevents the bottle 101 cap 102 from screwing onto and being removed from the bottle 101.

The plurality of permutation rotors 131 comprises a collection of individual permutation rotors 141.

Each individual permutation rotor 141 is a ring-shaped structure. The characteristic aperture formed by the ring structure of the individual permutation rotor 141 is geometrically similar to the pan structure 121 of the bottle 101 cap 102. The span of the length of the inner diameter of the characteristic aperture of the individual permutation rotor 141 is greater than the span of the length of the outer diameter of the pan structure 121 of the bottle 101 cap 102 such that the individual permutation rotor 141 fits around the lateral face of the pan structure 121.

Each individual permutation rotor 141 is secured to the lateral face of the pan structure 121 such that each individual permutation rotor 141 rotates relative to the pan structure 121. Each individual permutation rotor 141 is secured to the lateral face of the pan structure 121 such that any first individual permutation rotor 141 selected from the plurality of permutation rotors 131 will rotate relative to any second individual permutation rotor 141 selected from the plurality of permutation rotors 131.

Each individual permutation rotor 141 is secured to the lateral face of the pan structure 121 such that the rotation of any first individual permutation rotor 141 selected from the plurality of permutation rotors 131 is independent of the rotation of any second individual permutation rotor 141 selected from the plurality of permutation rotors 131. The independent rotation of each individual permutation rotor 141 selected from the plurality of permutation rotors 131 allows the plurality of permutation rotors 131 to be rotated into the position that aligns the plurality of permutation rotors 131 into the previously determined pattern that moves the permutation lock structure 103 into its unlocked state.

Each individual permutation rotor 141 comprises a rotor ring 142, an orientation image 143, and a pin structure 144.

The rotor ring 142 is a disk-shaped structure. The rotor ring 142 has a ring shape. The rotor ring 142 physically forms the ring structure of the individual permutation rotor 141. The rotor ring 142 is the physical structure of the individual permutation rotor 141 that is rotated to align the permutation lock structure 103 into the unlocked position. The characteristic aperture formed by the ring structure of the rotor ring 142 is a negative space. The characteristic aperture formed by the ring structure of the rotor ring 142 forms a composite prism structure with the rotor ring 142. The rotor ring 142 further comprises an inner lateral face 151 and an outer lateral face 152.

The inner lateral face 151 is the lateral face of the negative space that forms the characteristic aperture of the ring structure of the rotor ring 142. The inner lateral face 151 forms the inner perimeter of the ring structure of the rotor ring 142. The outer lateral face 152 is the lateral face of the disk structure of the rotor ring 142. The outer lateral face 152 forms the outer perimeter of the ring structure of the rotor ring 142.

The orientation image 143 is a collection of indicia that are formed on the outer lateral face 152 of the ring structure of the rotor ring 142. The orientation image 143 forms a set of positional markers that marks a set of fixed positions on the rotor ring 142.

The use of the orientation image 143 on the rotor ring 142 of each individual permutation rotor 141 allows the user to rotate the position of any first individual permutation rotor 141 selected from the plurality of permutation rotors 131 to a previously determined position relative to any second individual permutation rotor 141 selected from the plurality of permutation rotors 131. The use of the orientation image 143 visually allows the plurality of permutation rotors 131 to be rotated into the position that aligns the plurality of permutation rotors 131 into the previously determined pattern that moves the permutation lock structure 103 into its unlocked state.

In the first potential embodiment of the disclosure, each indicia presented by the orientation image 143 presents the sentiment of a number.

The pin structure 144 is a prism-shaped structure. The pin structure 144 is formed on the inner lateral face 151 of the rotor ring 142. The pin structure 144 of any first individual permutation rotor 141 selected from the plurality of permutation rotors 131 is geometrically identical to the pin structure 144 of any second individual permutation rotor 141 selected from the plurality of permutation rotors 131.

The position of the pin structure 144 relative to the orientation image 143 is known for each individual permutation rotor 141 selected from the plurality of permutation rotors 131. The position of the pin structure 144 relative to the orientation image 143 can vary between any two individual permutation rotors 141 selected from the plurality of permutation rotors 131.

When the plurality of images presented by the plurality of permutation rotors 131 are aligned into the previously determined pattern that unlocks the permutation lock structure 103, the pin structure 144 of each of the individual permutation rotors 141 are aligned to form a composite prism structure that is further aligned with the center axis of the exterior pin slot 114 of the exterior screw thread 113 on the neck 112 of the bottle 101. This alignment of the pin structures 144 allows the bottle 101 cap 102 to be removed from the neck 112 of the bottle 101.

When the plurality of images presented by the plurality of permutation rotors 131 are not aligned into the previously determined pattern that unlocks the permutation lock structure 103, one or more of the pin structures 144 of the individual permutation rotors 141 are moved out of alignment with the exterior pin slot 114 such that the bottle 101 cap 102 remains secured, or locked, to the neck 112 of the bottle 101.

The following definitions were used in this disclosure:

Align: As used in this disclosure, align refers to an arrangement of objects that are: 1) arranged in a straight plane or line; 2) arranged to give a directional sense of a plurality of parallel planes or lines; or, 3) a first line or curve is congruent to and overlaid on a second line or curve.

Bottle: As used in this disclosure, a bottle is a container used for the storage of fluids. Access to the interior of a bottle is gained through the neck of the bottle. The neck is an elongated tube that forms an aperture through which fluids can be introduced and removed from the bottle.

Bottle Cap: As used in this disclosure, a bottle cap refers to a lid that is used to enclose the open neck of a bottle. A disposable bottle cap refers to a bottle cap that must be pried off of the neck of the bottle. A reusable bottle cap refers to a bottle cap that attaches to the neck of the bottle using a threaded connection.

Center: As used in this disclosure, a center is a point that is: 1) the point within a circle that is equidistant from all the points of the circumference; 2) the point within a regular polygon that is equidistant from all the vertices of the regular polygon; 3) the point on a line that is equidistant from the ends of the line; 4) the point, pivot, or axis around which something revolves; or, 5) the centroid or first moment of an area or structure. In cases where the appropriate definition or definitions are not obvious, the fifth option should be used in interpreting the specification.

Center Axis: As used in this disclosure, the center axis is the axis of a cylinder or a prism. The center axis of a prism is the line that joins the center point of the first congruent face of the prism to the center point of the second corresponding congruent face of the prism. The center axis of a pyramid refers to a line formed through the apex of the pyramid that is perpendicular to the base of the pyramid. When the center axes of two cylinder, prism or pyramidal structures share the same line they are said to be aligned. When the center axes of two cylinder, prism or pyramidal structures do not share the same line they are said to be offset.

Center of Rotation: As used in this disclosure, the center of rotation is the point of a rotating plane that does not move with the rotation of the plane. A line within a rotating three-dimensional object that does not move with the rotation of the object is also referred to as an axis of rotation.

Closed Position: As used in this disclosure, a closed position refers to a movable barrier structure that is in an orientation that prevents passage through a port or an aperture. The closed position is often referred to as an object being "closed." Always use orientation.

Composite Prism: As used in this disclosure, a composite prism refers to a structure that is formed from a plurality of structures selected from the group consisting of a prism structure and a pyramid structure. The plurality of selected structures may or may not be truncated. The plurality of prism structures are joined together such that the center axes of each of the plurality of structures are aligned. The congruent ends of any two structures selected from the group consisting of a prism structure and a pyramid structure need not be geometrically similar.

Congruent: As used in this disclosure, congruent is a term that compares a first object to a second object. Specifically, two objects are said to be congruent when: 1) they are geometrically similar; and, 2) the first object can superimpose over the second object such that the first object aligns, within manufacturing tolerances, with the second object.

Correspond: As used in this disclosure, the term correspond is used as a comparison between two or more objects wherein one or more properties shared by the two or more objects match, agree, or align within acceptable manufacturing tolerances.

Disk: As used in this disclosure, a disk is a prism-shaped object that is flat in appearance. The disk is formed from two congruent ends that are attached by a lateral face. The sum of the surface areas of two congruent ends of the prism-shaped object that forms the disk is greater than the surface area of the lateral face of the prism-shaped object that forms the disk. In this disclosure, the congruent ends of the prism-shaped structure that forms the disk are referred to as the faces of the disk.

Exterior: As used in this disclosure, the exterior is used as a relational term that implies that an object is not contained within the boundary of a structure or a space.

Exterior Screw Thread: An exterior screw thread is a ridge wrapped around the outer surface of a tube in the form of a helical structure that is used to convert rotational movement into linear movement.

Flow: As used in this disclosure, a flow refers to the passage of a fluid past a fixed point. This definition considers bulk solid materials as capable of flow.

Fluid: As used in this disclosure, a fluid refers to a state of matter wherein the matter is capable of flow and takes the shape of a container it is placed within. The term fluid commonly refers to a liquid or a gas.

Form Factor: As used in this disclosure, the term form factor refers to the size and shape of an object.

Gas: As used in this disclosure, a gas refers to a state (phase) of matter that is fluid and that fills the volume of the structure that contains it. Stated differently, the volume of a gas always equals the volume of its container.

Geometrically Similar: As used in this disclosure, geometrically similar is a term that compares a first object to a second object wherein: 1) the sides of the first object have a one to one correspondence to the sides of the second object; 2) wherein the ratio of the length of each pair of corresponding sides are equal; 3) the angles formed by the first object have a one to one correspondence to the angles of the second object; and, 4) wherein the corresponding angles are equal. The term geometrically identical refers to a situation where the ratio of the length of each pair of corresponding sides equals 1.

Helix: As used in this disclosure, a helix is the three-dimensional structure that would be formed by a wire that is wound uniformly around the surface of a cylinder or a cone. If the wire is wrapped around a cylinder the helix is called a cylindrical helix. If the wire is wrapped around a cone, the helix is called a conical helix. A synonym for conical helix would be a volute.

Image: As used in this disclosure, an image is an optical representation or reproduction of an indicia or of the appearance of something or someone. See indicia sentiment optical character recognition.

Independent: As used in this disclosure, the term independent refers to the relationship between the operation and control of a first device and a second device. The first device and the second device are independent from each other if: a) the operation of the first device is neither impacted nor influenced by the operation of the second device; and, b) the operation of the second device is neither impacted nor influenced by the operation of the first device.

Indicia: As used in this disclosure, the term indicia refers to a set of markings that identify a sentiment.

Inner Dimension: As used in this disclosure, the term inner dimension describes the span from a first inside or interior surface of a container to a second inside or interior surface of a container. The term is used in much the same way that a plumber would refer to the inner diameter of a pipe.

Inner Perimeter and Outer Perimeter: As used in this disclosure, the inner perimeter and the outer perimeter refer to two geometrically similar structures of a curved object. The inner perimeter refers to the geometrically similar structure with the shorter span of length. The outer perimeter refers to the geometrically similar structure with the greater span of length.

Interior: As used in this disclosure, the interior is used as a relational term that implies that an object is contained within the boundary of a structure or a space.

Interior Screw Thread: An interior screw thread is a groove that is formed around the inner surface of a tube in the form of a helical structure that is used to convert rotational movement into linear movement.

Liquid: As used in this disclosure, a liquid refers to a state (phase) of matter that is fluid and that maintains, for a given pressure, a fixed volume that is independent of the volume of the container.

Lock: As used in this disclosure, a lock is a releasable fastening device that secures a rotating mechanical device into a fixed position.

Loop: As used in this disclosure, a loop is the length of a first linear structure including, but not limited to, shafts, lines, cords, or webbings, that is: 1) folded over and joined at the ends forming an enclosed space; or, 2) curved to form a closed or nearly closed space within the first linear structure. In both cases, the space formed within the first linear structure is such that a second linear structure such as a line, cord or a hook can be inserted through the space formed within the first linear structure. Within this disclosure, the first linear structure is said to be looped around the second linear structure.

Negative Space: As used in this disclosure, negative space is a method of defining an object through the use of open or empty space as the definition of the object itself, or, through the use of open or empty space to describe the boundaries of an object.

One to One: When used in this disclosure, a one to one relationship means that a first element selected from a first set is in some manner connected to only one element of a second set. A one to one correspondence means that the one to one relationship exists both from the first set to the second set and from the second set to the first set. A one to one fashion means that the one to one relationship exists in only one direction.

Open Position: As used in this disclosure, an open position refers to a movable barrier structure that is in an orientation that allows passage through a port or an aperture. The open position is often referred to as an object being "open."

Orientation: As used in this disclosure, orientation refers to the positioning of a first object relative to: 1) a second object; or, 2) a fixed position, location, or direction.

Outer Dimension: As used in this disclosure, the term outer dimension describes the span from a first exterior or outer surface of a tube or container to a second exterior or outer surface of a tube or container. The term is used in much the same way that a plumber would refer to the outer diameter of a pipe.

Pan: As used in this disclosure, a pan is a hollow and prism-shaped containment structure. The pan has a single open face. The open face of the pan is often, but not always, the superior face of the pan. The open face is a surface selected from the group consisting of: a) a congruent end of the prism structure that forms the pan; and, b) a lateral face of the prism structure that forms the pan. A semi-enclosed pan refers to a pan wherein the closed end of prism structure of the pan and/or a portion of the closed lateral faces of the pan is are open.

Perimeter: As used in this disclosure, a perimeter is one or more curved or straight lines that bounds an enclosed area on a plane or surface. The perimeter of a circle is commonly referred to as a circumference.

Permutation Lock and Combination Lock: As used in this disclosure, the permutation lock and the combination lock are locks that are opened by entering a set of previously determined set of numbers. A combination lock requires that each number be entered sequentially into the lock. A permutation lock requires the single entry of a single number. Each number contained in the set of previously determined numbers used in a combination lock is generally formed as a sequence of two digit numbers. The number that forms the set of previously determined numbers used in a permutation lock generally comprises three or more digits. The combination lock can be identified by the presence of a dial. A permutation lock can often be identified by the presence of a numbered rotor for each digit that forms the number that forms the set of previously determined numbers.

Prism: As used in this disclosure, a prism is a three-dimensional geometric structure wherein: 1) the form factor of two faces of the prism are congruent; and, 2) the two congruent faces are parallel to each other. The two congruent faces are also commonly referred to as the ends of the prism. The surfaces that connect the two congruent faces are called the lateral faces. In this disclosure, when further description is required a prism will be named for the geometric or descriptive name of the form factor of the two congruent faces. If the form factor of the two corresponding faces has no clearly established or well-known geometric or descriptive name, the term irregular prism will be used. The center axis of a prism is defined as a line that joins the center point of the first congruent face of the prism to the center point of the second corresponding congruent face of the prism. The center axis of a prism is otherwise analogous to the center axis of a cylinder. A prism wherein the ends are circles is commonly referred to as a cylinder.

Ring: As used in this disclosure, a ring is term that is used to describe a disk-like structure through which an aperture is formed. Rings are often considered loops.

Rotation: As used in this disclosure, rotation refers to the cyclic movement of an object around a fixed point or fixed 6 axis. The verb of rotation is to rotate.

7 Screw: As used in this disclosure, to screw is a verb meaning: 1) to fasten or unfasten (unscrew) a threaded connection; or 2) to attach a helical structure to a solid structure.

Sentiment: As used in this disclosure, a sentiment refers to a symbolic meaning or message that is communicated through the use of an image, potentially including a text based image.

Slot: As used in this disclosure, a slot is a prism-shaped negative space formed as a groove or aperture that is formed in or through an object.

Such As: As used in this disclosure, the term "such as" is a conjunction that relates a first phrase to a subsequent phrase. The term "such as" is used to introduce representative examples of structures that meet the requirements of the first phrase. As a first example of the use of the term "such as," the phrase: "the first textile attaches to the second textile using a fastener such as a hook and loop fastener" is taken to mean that a hook and loop fastener is suitable to use as the fastener but is not meant to exclude the use of a zipper or a sewn seam. As a second example of the use of the term "such as," the phrase: "the chemical substance is a halogen such as chlorine or bromine" is taken to mean that either chlorine or bromine are suitable for use as the halogen but is not meant to exclude the use of fluorine or iodine.

Such That: As used in this disclosure, the term "such that" is a conjunction that relates a first phrase to a subsequent phrase. The term "such that" is used to place a further limitation or requirement to the first phrase. As a first example of the use of the term "such that," the phrase: "the door attaches to the wall such that the door rotates relative to the wall" requires that the attachment of the door allows for this rotation. As a second example of the use of the term "such that," the phrase: "the chemical substance is selected such that the chemical substance is soluble in water" requires that the selected chemical substance is soluble in water. As a third example of the use of the term "such that," the phrase: "the lamp circuit is constructed such that the lamp circuit illuminates when the lamp circuit detects darkness" requires that the lamp circuit: a) detect the darkness; and, b) generate the illumination when the darkness is detected.

Threaded Connection: As used in this disclosure, a threaded connection is a type of fastener that is used to join a first cylindrical object and a second cylindrical object together. The first cylindrical object is fitted with a first fitting selected from an interior screw thread or an exterior screw thread. The second cylindrical object is fitted with the remaining screw thread. The cylindrical object fitted with the exterior screw thread is placed into the remaining cylindrical object such that: 1) the interior screw thread and the exterior screw thread interconnect; and, 2) when the cylindrical object fitted with the exterior screw thread is rotated the rotational motion is converted into linear motion that moves the cylindrical object fitted with the exterior screw thread either into or out of the remaining cylindrical object. The direction of linear motion is determined by the direction of rotation.

Tube: As used in this disclosure, a tube is a hollow prism-shaped device formed with two open congruent ends. The tube is used for transporting liquids (including bulk solids) and gases. The line that connects the center of the first congruent face of the prism to the center of the second congruent face of the prism is referred to as the center axis of the tube or the centerline of the tube. When two tubes share the same centerline they are said to be aligned. When the centerlines of two tubes are perpendicular to each other, the tubes are said to be perpendicular to each other. In this disclosure, the terms inner dimensions of a tube and outer dimensions of a tube are used as they would be used by those skilled in the plumbing arts.

With respect to the above description, it is to be realized that the optimum dimensional relationship for the various components of the invention described above and in FIGS. 1 through 6 include variations in size, materials, shape, form, function, and manner of operation, assembly and use, are deemed readily apparent and obvious to one skilled in the art, and all equivalent relationships to those illustrated in the drawings and described in the specification are intended to be encompassed by the invention.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A lock for a bottle comprising a bottle, a bottle cap, and a permutation lock structure;

wherein the permutation lock structure mounts in the bottle cap;

wherein the bottle cap attaches to the bottle;

wherein each individual permutation rotor comprises a rotor ring, an orientation image, and a pin structure;

wherein the rotor ring is a disk-shaped structure;

wherein the rotor ring has a ring shape;

wherein the rotor ring is a physical structure of the individual permutation rotor that is rotated to align the permutation lock structure into the unlocked position;

wherein a characteristic aperture formed by the ring structure of the rotor ring is a negative space;

wherein the characteristic aperture formed by the ring structure of the rotor ring forms a composite structure with the rotor ring;

wherein the rotor ring further comprises an inner lateral face and an outer lateral face;

wherein the inner lateral face is the lateral face of the negative space that forms the characteristic aperture of the ring structure of the rotor ring;

wherein the inner lateral face forms the inner perimeter of the ring structure of the rotor ring;

wherein the outer lateral face is the lateral face of the disk structure of the rotor ring;

wherein the outer lateral face forms the outer perimeter of the ring structure of the rotor ring;

wherein the orientation image is a collection of indicia that are formed on the outer lateral face of the ring structure of the rotor ring;

wherein the orientation image forms a set of positional markers that marks a set of fixed positions on the rotor ring;

wherein the pin structure is formed on the inner lateral face of the rotor ring;

wherein the pin structure of any first individual permutation rotor selected from the plurality of permutation rotors is geometrically identical to the pin structure of any second individual permutation rotor selected from the plurality of permutation rotors.

2. The lock for a bottle according to claim 1 wherein the lock for a bottle is a containment structure;

wherein the lock for a bottle is a secured device;

wherein by secured device is meant that the structure of the lock for a bottle is formed with a lock that prevents unauthorized entry into the lock for a bottle;

wherein the bottle cap forms a fluid impermeable seal with the bottle;

wherein the permutation lock structure fixes the bottle cap in the closed position.

3. The lock for a bottle according to claim 2 wherein the bottle forms a containment structure;

wherein the bottle forms a fluid impermeable structure.

4. The lock for a bottle according to claim 3 wherein the bottle cap is a pan shaped structure;

wherein the bottle cap attaches to the bottle to form a fluid impermeable seal;

wherein the bottle cap attaches to the bottle using a threaded connection;

wherein the bottle cap encloses the bottle;

wherein the bottle cap screws onto the neck of the bottle.

5. The lock for a bottle according to claim 4 wherein the permutation lock structure attaches to the bottle cap;

wherein the permutation lock structure releasably locks the bottle cap to the bottle in the closed position;

wherein the permutation lock structure is a permutation lock;

wherein the permutation lock structure is released by entering a previously determined number into the permutation lock structure;

wherein the permutation lock structure is geometrically similar to the neck of the bottle;

wherein the permutation lock structure mounts on an exterior lateral face of the pan structure of the bottle cap;

wherein the plurality of permutation rotors forms a framework that attaches to the lateral face of the pan structure of the bottle cap.

6. The lock for a bottle according to claim 5 wherein the plurality of permutation rotors forms a rotating structure;

wherein the plurality of permutation rotors presents a plurality of images such that the plurality of images are visible from the exterior of the bottle cap;

wherein the position of any first image presented by the plurality of permutation rotors changes relative to the position of at least one other image presented by the bottle cap when the plurality of permutation rotors is rotated;

wherein when the plurality of images presented by the plurality of permutation rotors are aligned into a previously determined pattern, the permutation lock structure goes into an "unlocked" state that allows the bottle cap to be screwed onto and removed from the bottle;

wherein when the plurality of images presented by the plurality of permutation rotors are not aligned into the previously determined pattern, the permutation lock structure goes into a "locked" state that prevents the bottle cap from screwing onto and being removed from the bottle.

7. The lock for a bottle according to claim 6 wherein the bottle comprises a container, a neck, an exterior screw thread, and an exterior pin slot;

wherein the neck attaches to the container;

wherein the exterior screw thread and the exterior pin slot are formed on the neck.

8. The lock for a bottle according to claim 7 wherein the bottle cap comprises a pan structure and an interior screw thread;

wherein the interior screw thread is formed in the pan structure.

9. The lock for a bottle according to claim 8 wherein the permutation lock structure further comprises a plurality of permutation rotors;

wherein each individual permutation rotor is a ring-shaped structure.

10. The lock for a bottle according to claim 9 wherein the container forms a fluid impermeable containment space;

wherein the container approximates a pan shape.

11. The lock for a bottle according to claim 10 wherein the neck forms an aperture that provides access to the interior containment space of the container;

wherein the neck is a tubular structure;

wherein the structure of the neck encloses the open face of the pan shape of the container such that the neck and the container combine to form the composite structure of the bottle.

12. The lock for a bottle according to claim 11
wherein the exterior screw thread forms a portion of the threaded connection that secures the bottle cap to the neck of the bottle;
wherein the exterior screw thread is formed on an exterior lateral face of the neck;
wherein the exterior pin slot is a negative space;
wherein the exterior pin slot is formed into the exterior screw thread of the bottle such that the center axis of the exterior pin slot is parallel to the center axis of the composite structure of the bottle;
wherein the exterior pin slot forms a release channel used by the permutation lock structure to allow the bottle cap to be placed onto and removed from the bottle.

13. The lock for a bottle according to claim 12
wherein a pan structure is a hollow structure;
wherein the pan structure has a pan shape;
wherein the pan shape of the pan structure is geometrically similar to the neck of the bottle;
wherein the span of the length of the inner diameter of the pan structure is greater than the span of the length of the outer diameter of the neck of the bottle such that the neck inserts into the pan structure as the bottle cap screws onto the neck;
wherein the pan structure encloses the neck of the bottle;
wherein the pan structure forms a fluid impermeable seal with the neck.

14. The lock for a bottle according to claim 13
wherein the interior screw thread forms a portion of the threaded connection that secures the bottle cap to the neck of the bottle;
wherein the interior screw thread is formed on an interior lateral face of the pan structure;
wherein the interior screw thread is sized such that the exterior screw thread screws into the interior screw thread as the bottle cap is screwed onto the neck of the bottle.

15. The lock for a bottle according to claim 14
wherein a characteristic aperture formed by the ring structure of the individual permutation rotor is geometrically similar to the pan structure of the bottle cap;
wherein a span of a length of an inner diameter of the characteristic aperture of the individual permutation rotor is greater than the span of the length of the outer diameter of the pan structure of the bottle cap such that the individual permutation rotor fits around the lateral face of the pan structure;
wherein each individual permutation rotor is secured to the lateral face of the pan structure such that each individual permutation rotor rotates relative to the pan structure;
wherein each individual permutation rotor is secured to the lateral face of the pan structure such that any first individual permutation rotor selected from the plurality of permutation rotors will rotate relative to any second individual permutation rotor selected from the plurality of permutation rotors;
wherein each individual permutation rotor is secured to the lateral face of the pan structure such that the rotation of any first individual permutation rotor selected from the plurality of permutation rotors is independent of the rotation of any second individual permutation rotor selected from the plurality of permutation rotors;
wherein the independent rotation of each individual permutation rotor selected from the plurality of permutation rotors allows the plurality of permutation rotors to be rotated into the position that aligns the plurality of permutation rotors into the previously determined pattern that moves the permutation lock structure into its unlocked state.

* * * * *